US007690092B2

(12) United States Patent
Wagener

(10) Patent No.: US 7,690,092 B2
(45) Date of Patent: Apr. 6, 2010

(54) MULTIAXIAL COMPLEX

(75) Inventor: Gert Herrn Wagener, Emsdetten (DE)

(73) Assignee: Saertex GmbH & Co KG, Saerbeck (DE)

( * ) Notice: Subject to any disclaimer, the term of this patent is extended or adjusted under 35 U.S.C. 154(b) by 431 days.

(21) Appl. No.: 10/598,727

(22) PCT Filed: Mar. 10, 2004

(86) PCT No.: PCT/DE2004/000459

§ 371 (c)(1),
(2), (4) Date: Sep. 8, 2006

(87) PCT Pub. No.: WO2005/087996

PCT Pub. Date: Sep. 22, 2005

(65) Prior Publication Data

US 2007/0184738 A1 Aug. 9, 2007

(51) Int. Cl.
*D04B 21/14* (2006.01)

(52) U.S. Cl. ..... 28/102; 28/140; 28/282

(58) Field of Classification Search ..... 28/282, 28/172.1, 102, 101, 140, 158; 66/84 A, 203, 66/83, 84 R, 125 R, 85 R; 156/180
See application file for complete search history.

(56) References Cited

U.S. PATENT DOCUMENTS

| | | | | | |
|---|---|---|---|---|---|
| 3,761,345 | A * | 9/1973 | Smith | 112/415 |
| 3,819,469 | A * | 6/1974 | Balch et al. | 428/219 |
| 5,055,242 | A * | 10/1991 | Vane | 264/463 |
| 5,269,863 | A * | 12/1993 | Middelman | 156/177 |
| 5,688,577 | A * | 11/1997 | Smith et al. | 428/113 |
| 5,809,805 | A * | 9/1998 | Palmer et al. | 66/84 A |
| 6,151,923 | A * | 11/2000 | Gruenert et al. | 66/84 A |
| 6,585,842 | B1 * | 7/2003 | Bompard et al. | 156/166 |
| 6,668,596 | B1 * | 12/2003 | Wagener | 66/84 A |
| 2003/0172506 | A1 * | 9/2003 | Guirman et al. | 28/282 |
| 2004/0082244 | A1 * | 4/2004 | Loubinoux | 442/181 |

* cited by examiner

*Primary Examiner*—Amy B Vanatta
(74) *Attorney, Agent, or Firm*—Merchant & Gould P.C.

(57) ABSTRACT

The invention relates to a multiaxial complex of multifilament threads formed of continuous filaments, whereby the multifilament threads are placed on top of one another in different orientations, and the threads of the 0° layers run in the production direction, and whereby the multifilament threads of the 0° layers are laid in between the other multifilament layers layered in different orientations and, spread apart and without any torsion before their placement, are placed onto the previous multifilament layer.

7 Claims, 1 Drawing Sheet

MULTIAXIAL COMPLEX

Figure 1:
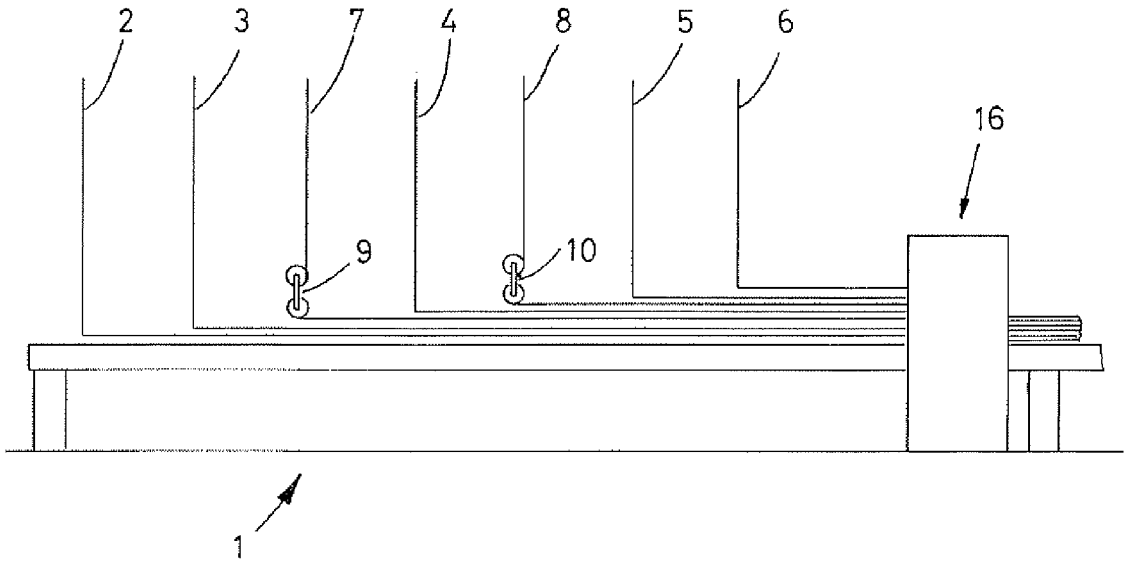

The invention relates to a multiaxial complex of multifilament threads according to the preamble of claim 1.

Furthermore, the invention relates to a device for the production of a multiaxial complex of multifilament threads according to the preamble of claim 2.

Finally, the invention relates to a method for the production of a multiaxial complex of multifilament threads according to the preamble of claim 3.

In the prior art the production of multifilament complexes is known, for example, from "Multi-Axiale Kettengewirke als textile Verstärkung in Faserverbundwerkstoffen" (Multiaxial warp-knitted fabrics as textile reinforcement in fiber composites), Melliand Textilberichte, International Textile Reports, DE, Melliand Textilberichte K. G. Heidelberg, vol. 70, no. 2, pages 109-112, XP000026288 ISSN: 0341-0781. In many cases, multiaxial complexes or multiaxial scrims of this type are made of multifilaments of continuous filaments produced from fibers that are very susceptible to bending and breaking. These multifilament threads of continuous filaments have a certain torsional tendency, as a result of which these multifilament threads are not fixed in their position after having been laid down on a base.

In order to achieve a position-fixing of this type, it was customary in the prior art to arrange the multifilament threads of the 0° layers as the top ply in an individually guided manner on the scrim, whereby an overstressing of the fibers of these multifilament threads then occurred when the finished scrim was wound onto a cloth beam. Therefore, the procedure followed until now with a multiaxial scrim having a plurality of individual layers, e.g., six or seven layers, was such that scrims with, e.g., two or three layers were produced, in which the 0° mutifilaments were arranged in the top layer, then one of these scrims was turned around, so that then two scrims were placed on top of one another, in which scrims the 0° multifilaments were arranged in the center, thus theoretically in the so-called neutral zone. These scrims, already sewed once, had to be sewed a third time, namely when the two scrims were assembled. As a result of the plurality of sewing processes, damage of the fibers of the multifilaments occurred.

A method and a device for producing a thread lattice has become known from DE 39 10 245 A1. In order to achieve an extensive isotropy of the thread lattice, it is suggested here to introduce additional threads in the longitudinal direction above, below or between the individual sheets of the threads already laid down and running in both the transverse and the diagonal direction. Feeding in the longitudinal direction, i.e., the 0° multifilament threads, directly before the sewing site is possible if the 0° threads are to be laid between the individual cross threads. But these 0° threads fed at any desired location do not maintain their intended position and desired homogeneous distribution, but shift so that different thicknesses and thus different strengths in the transverse direction of the scrim are the inevitable result.

It is further suggested that the threads laid down should be connected among one another through lamination by means of adhesive films or adhesive liquids. An additional treatment of this type naturally limits the scope of application of the thread lattice.

It has become known from EP 1 112 400 B1 to guide the threads of the 0° layers by means of auxiliary means securing position or securing distribution in the area before the sewing-knitting machine. An additional expenditure is required here. Although an excellent scrim is achieved, the additional expenditure increases production costs.

DE 199 13 647 A1 describes a method and a device for producing knitted or sewed multiaxial scrims of several layers, whereby at least two knitting heads are provided arranged one after the other in the working direction, which knitting heads fix the thread layers laid down in front of the knitting heads essentially immediately after they have been laid down. Thus it is to be rendered possible to draw in stationary thread layers between the weft thread layers, which stationary thread layer is fastened by the separate knitting head immediately after having been placed onto the weft thread layer. Through the additional knitting heads between weft insertion system it is rendered possible to achieve a high flexibility with respect to the arrangement of the 0° thread layers between the plies of customary thread orientation.

A method and a device for applying a fiber ply to the back of a textile fabric have become known from DE 101 33 622 C1. Here the problem is solved of guiding a fiber ply preferably made of fiber chips toward the back of a textile fabric, in particular a thread composite, and bonding this fiber ply in a single operation together with the thread composite and potentially with a top fiber ply. Drawing in 0° thread at desired locations of a multiaxial scrim is neither described nor made obvious in this reference.

It is thus the object of the present invention to suggest a multiaxial complex of multifilament threads that can be produced without additional chemical means, such as adhesive, etc., and with which the position-fixing of the multifilament threads in the 0° layers can be achieved without great expenditure in terms of machinery. The invention further relates to a device for producing a complex of this type and to a method for producing a complex of this type.

The first object of the invention is attained in that the multifilament threads of the 0° layers are laid in between the other multifilament layers layered in different orientations and are fed spread apart and without any torsion before their placement and are placed onto the previous multifilament layer in this form.

The device for producing a scrim of this type is characterized in that press rollers are engaged in the feeding of the multifilament threads, over which rollers the multifilament threads are guided, The method for producing a multiaxial complex of this type is characterized in that the multifilament threads of the 0° layer are guided over press rollers before being laid down on the previous multifilament layer, which rollers cause a spreading apart of the multifilament threads and thus make them free of torsion.

Surprisingly, it was proven that there is sufficient position-fixing with the use of torsion-free multifilament threads of the 0° layers and that, furthermore, the measure to maintain the multifilament threads without any torsion can be achieved in the simplest manner in that the threads are guided over press rollers, which cause the threads to be spread apart, if necessary, and thus spread out the threads flat which are otherwise fed as a strand.

Figure 2:
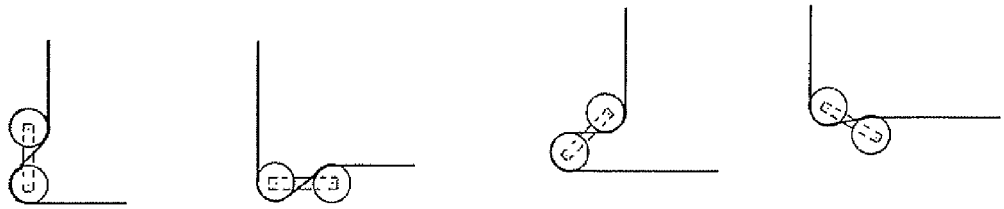

An exemplary embodiment of the invention is explained below on the basis of the drawing. The drawing thereby shows:

FIG. 1 The basic structure of a sewing or knitting machine for producing a multiaxial scrim and FIG. 2 The embodiment and position of the press rollers guiding the multifilament threads.

FIG. 1 shows a sewing or knitting machine 1 for producing a multiaxial scrim. 2, 3, 4, 5 and 6 represent weft insertion systems for the +/−45° to 90° threads and 7 and 8 represent the multifilament threads running in 0° layer.

Press rollers 9 and 10 are engaged in the feeding of these 0° multifilament threads, over which rollers the multifilament threads 7 and 8 are guided into the scrim. The scrim thus generated is guided to the sewing site 16, from where the finished scrim is guided to a cloth beam or the like.

FIG. 2 shows different alignments and forms of the press rollers, which is to illustrate that the type and embodiment of the press rollers can be arranged depending on the respective operating conditions.

The invention claimed is:

1. Method for producing a multiaxial complex of multifilament threads formed of continuous filaments, comprising:

guiding multifilament threads oriented in a production direction forming first layers over press rollers to spread apart the multifilament threads of the first layers and eliminate torsion from the multifilament threads of the first layers;

placing the multifilament threads on top of one another in different orientations;

laying the multifilament threads of the first layers between other multifilament layers layered in different orientations; and feeding the multifilament threads to sewing, wherein the multifilament threads of the first layers are fed to sewing without torsion.

2. A method according to claim 1, wherein a plurality of first layers are laid between the other multifilament layers layered in different orientations.

3. A method according to claim 2, wherein each of the plurality of first layers is separated from other first layers by at least one of the other multifilament layers layered in different orientations.

4. A method according to claim 1, wherein a top layer comprises one of the other multifilament layers layered in different orientations.

5. A method according to claim 4, wherein a bottom layer comprises one of the other multifilament layers layered in different orientations.

6. A method according to claim 3, wherein a top layer comprises one of the other multifilament layers layered in different orientations.

7. A method according to claim 6, wherein a bottom layer comprises one of the other multifilament layers layered in different orientations.

* * * * *